US006108990A

United States Patent [19]

Klamer

[11] Patent Number: 6,108,990

[45] **Date of Patent: *Aug. 29, 2000**

[54] CONNECTOR FOR BUILDING PANELS

[76] Inventor: Steven M. Klamer, 7547 Moon Valley Rd., North Beach, Wash. 97205

[ * ] Notice: This patent issued on a continued prosecution application filed under 37 CFR 1.53(d), and is subject to the twenty year patent term provisions of 35 U.S.C. 154(a)(2).

[21] Appl. No.: 09/079,820

[22] Filed: May 15, 1998

[51] Int. Cl.[7] ..... E04B 2/70

[52] U.S. Cl. ..... 52/281; 52/98; 52/100; 52/781; 52/285.1

[58] Field of Search ..... 52/98, 100, 281, 52/460, 285.1, 781

[56] References Cited

U.S. PATENT DOCUMENTS

| | | | |
|---|---|---|---|
| 1,913,066 | 6/1933 | Carter . | |
| 2,065,433 | 12/1936 | Dercum et al. | 52/281 X |
| 3,745,726 | 7/1973 | Thom | 52/98 |
| 3,886,709 | 6/1975 | Krah et al. . | |
| 4,063,393 | 12/1977 | Toti | 52/281 X |
| 4,112,636 | 9/1978 | Hays | 52/98 |
| 4,392,336 | 7/1983 | Ganssle | 52/417 |
| 4,397,123 | 8/1983 | Parker | 52/100 |
| 4,464,869 | 8/1984 | Parkin . | |
| 5,076,035 | 12/1991 | Wright . | |
| 5,657,599 | 8/1997 | Peterson et al. | 52/417 |

FOREIGN PATENT DOCUMENTS

| | | | |
|---|---|---|---|
| 1149294 | 4/1956 | France | 52/98 |

*Primary Examiner*—Carl D. Friedman
*Assistant Examiner*—Phi Dieu Tran A
*Attorney, Agent, or Firm*—Marger Johnson & McCollom, P.C.

[57] ABSTRACT

A building panel joint support including an elongate member having spaced apart raised surfaces defining a longitudinal recess.

5 Claims, 2 Drawing Sheets

CONNECTOR FOR BUILDING PANELS

BACKGROUND OF THE INVENTION

This invention is related to the mounting and joining of building panels, and in particular, to an apparatus for mounting and joining interior building panels such as sheetrock panels.

The most commonly used method for building and finishing interior walls and ceilings in both residential and commercial buildings includes framing a wall using vertical studs of metal or wood on 16" or 24" centers. Sheetrock panels are mounted on the studs, and the joints between adjacent sheetrock panels are filled with joint tape and a sandable spackling compound. Standard sheetrock panels are 8', 10', or 12' long so that the sheetrock joints most often fall between a vertical the 16" or 24" spaced studs. Inevitably, however, it is necessary to provide a joint between studs where the overall wall length does not correspond to an even multiple of 16" or 24". Doing so is time consuming because an additional stud to support the joint must be installed between two existing studs.

A need therefore remains for a simple, convenient and less time-consuming sheetrock joint-support for use where the joint falls between existing studs.

SUMMARY OF THE INVENTION

This invention provides a simple and convenient joint support for use with sheetrock, and one which facilitates ready spackling of the joint. The invention is also embodied in a formed panel which includes multiple joint supports separated by break lines which permit each single joint support to be readily broken away from the panel. In another aspect of the invention, each joint support includes a recessed portion which, when the panel edges are attached thereto, provides a convenient recessed area surrounding the joint for receiving joint tape and spackle compound. These and other features of the invention will be described in greater detail by reference to the drawings.

DETAILED DESCRIPTION OF THE DRAWINGS

Figure 1:
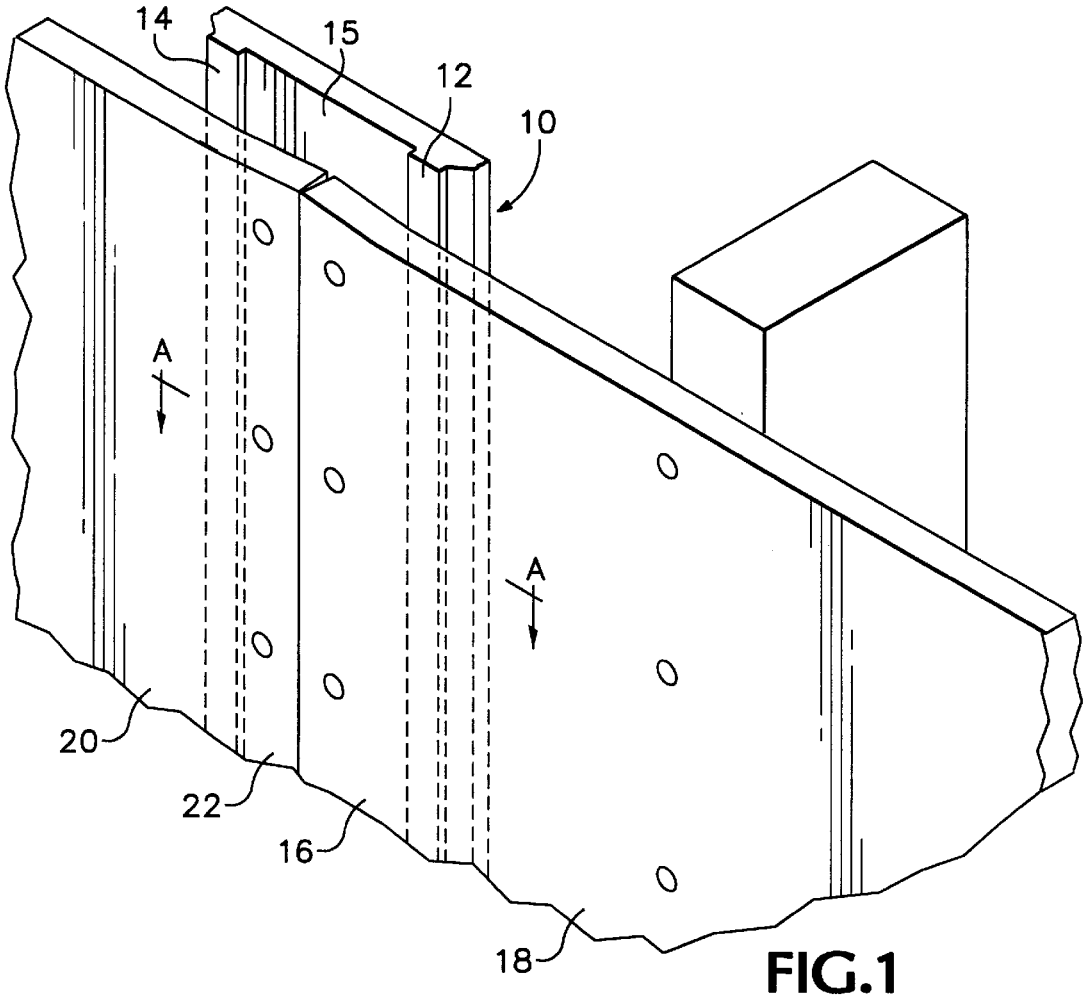
FIG. 1 is a partial perspective view of a wall including joint between adjacent building panels which is supported by a joint support (shown partially in phantom) of the present invention.
Figure 2:
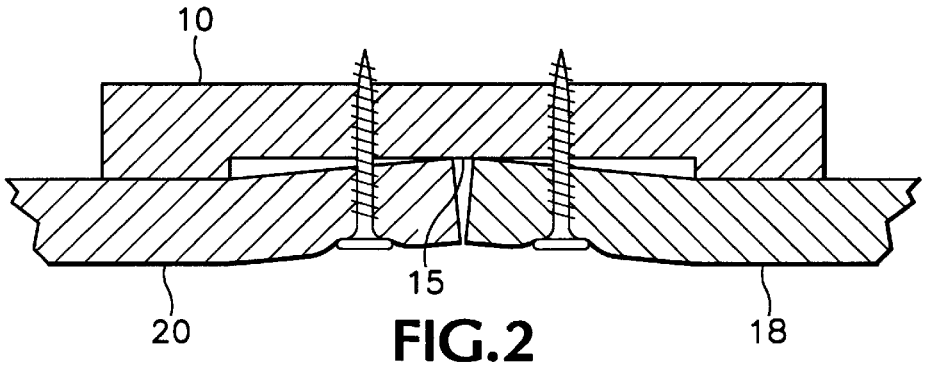
FIG. 2 is a cross-sectional view along line of a joint support according to the invention.
Figure 4:
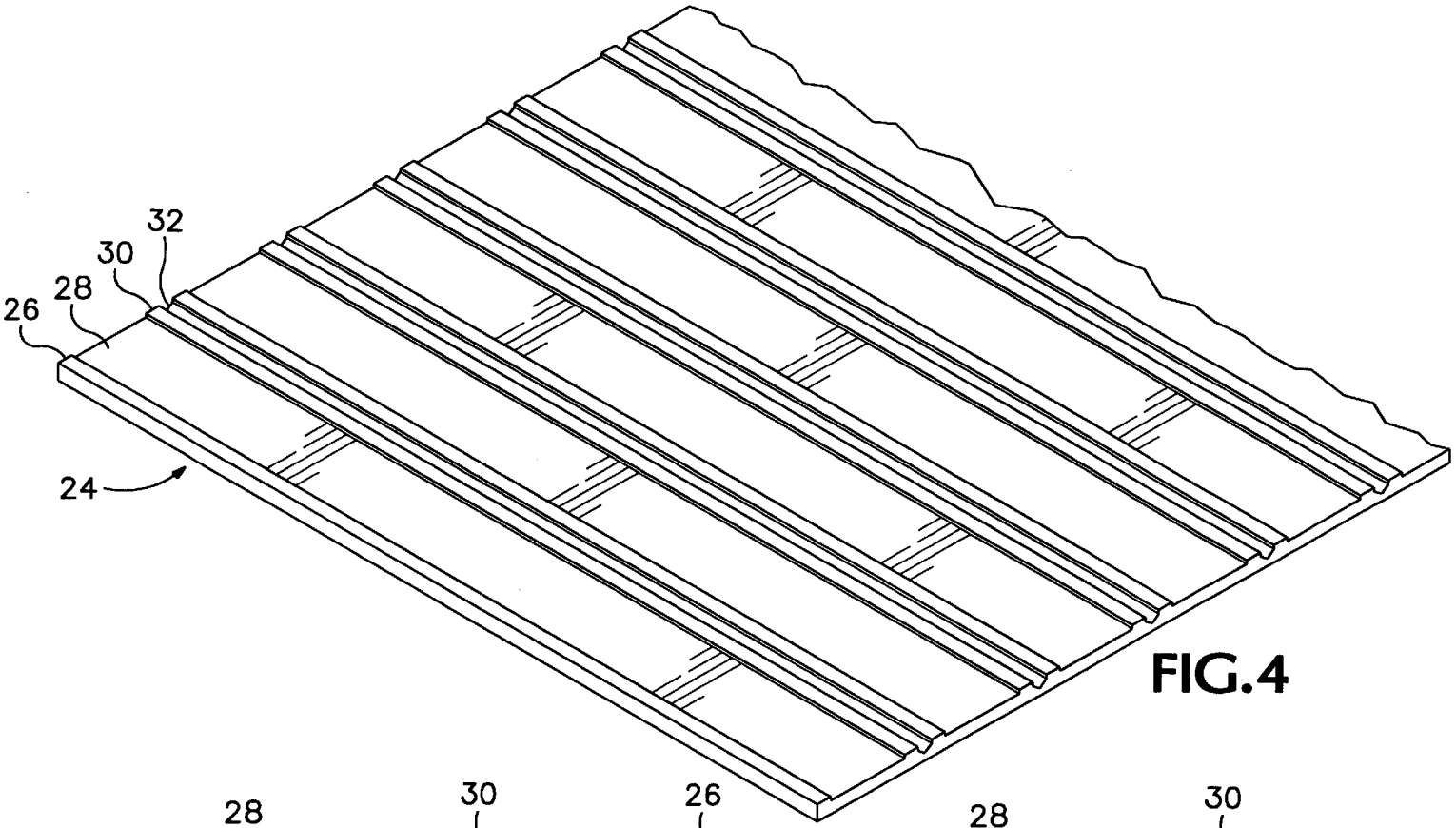
FIG. 4 is a perspective view of a formed panel comprising multiple joint supports generally like that of FIG. 3.
Figure 5:
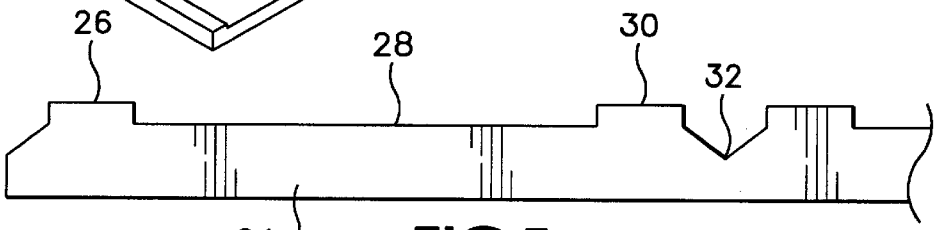
FIG. 5 is a partial end view of the formed panel shown in FIG. 4.
Figure 3:
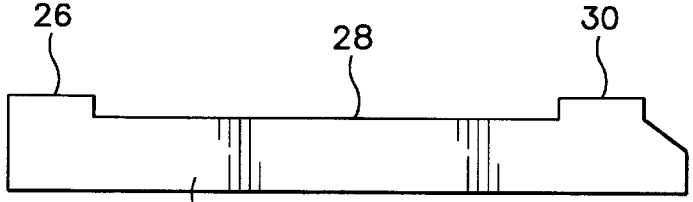
FIG. 3 is an end view of a joint support according to the invention.

Referring now to FIGS. 1–5, a joint support according to the invention is shown generally at 10. Joint support 10 generally comprises an elongate member having raised surfaces 12 and 14 along each lateral edge. Raised surfaces 12 and 14 define a longitudinal recess 15 along substantially the entire length of the joint support. The support is formed of a material, such as medium density fibre board (M.D.F.), into which nails or screws can be driven to attach the panels. One such material, in this case, Masonite, ⅜" minimum panel is required in order to pull ⅝" sheetrock in, to achieve recessed area for tape joint. It will be appreciated that numerous lignocellulosic and/or polymeric materials would be suitable for use in conjunction with the invention, and that the invention is not limited to any particular material. Referring in particular to FIGS. 1 and 2, the joint support 10 is utilized by securing the edge 16 of a first panel 18 to the joint support with panel edge 16 located approximately in the middle of the joint support. A second panel 20 is placed with its edge 22 adjacent edge 16 and secured to the joint support 10 as shown. The edges of the panels are thus joined and supported by the joint support without the need to mount an additional stud in the wall. In another aspect of the invention, when the joint support of the present invention is used as described, the panel edges and adjacent area of the sheetrock panels are recessed slightly relatively to the plane of the wall surface. The recessed area is then filled with joint tape and a spackle compound to seal the joint and cover the screw or nail holes in the panel surface. The invention thereby provides a completely suitable alternative to the mounting of an additional stud in the wall, and one which can be easily and readily utilized. In the preferred embodiment, the efficiency gained by use of the invention is enhanced in that multiple joint supports are provided in the form of a panel as shown at 24 in FIGS. 4 and 5. In general, panel 24 includes a repeating pattern of a raised surface 26, a recess 28, a second raised surface 30, and a break notch 32. As a joint support is needed, a single joint support 10 is separated from panel 24 by breaking the panel along a notch 32. The joint support needs no further preparation before being attached to the edge of a first sheetrock panel edge as discussed above. A sheetrock installer can readily carry a supply of joint supports in the form of a 4'x8' sheet, which can be conveniently carried and handled along with sheetrock panels, which are most often 4' in width.

While the invention is not limited to any particular material, a material which can be formed by machining or milling is preferred for economy of manufacture. For example, applicant has found that M.D.F. is quite suitable—it can be readily machined with the raised surfaces, recesses and notches. M.D.F. also receives screws well, and demonstrates sufficient pull strength to firmly secure the sheetrock panels to the joint support. In any event, the invention could well be practiced by using other materials, and the invention is not deemed by the inventor to be limited to any particular material.

While the most common application for the invention will be in the mounting of sheetrock panels for interior walls and ceilings, the invention is equally applicable to other types of panels in other applications as well.

What is claimed is:

1. A wall comprising:

a building panel joint support member including a first elongate member having a first front surface and first and second longitudinal edges, and first and second raised surfaces adjacent each said longitudinal edge, the first and second raised surfaces and said front surface defining a first longitudinal recess;

a first building panel having a first longitudinal edge connected to the recess;

a second building panel having a second longitudinal edge connected to the recess and adjacent the first longitudinal edge, wherein the second longitudinal edge of the second building panel runs parallel to the first and second raised surfaces; and, the first and second longitudinal edges and said support member forming a self-supporting recessed joint, said self-supporting recessed joint consisting of the first and second panels attached to said support member.

2. The wall of claim 1 further comprising a joint filling compound covering the recessed joint.

3. The wall of claim 1 wherein said building panel joint support member is formed of a lignocellulosic material.

4. The wall of claim 3 wherein said lignocellulosic material comprises a molded lignocellulosic material.

5. The wall of claim 1 wherein said building panels comprise sheetrock panels.

* * * * *